United States Patent [19]

Sündermeyer

[11] Patent Number: 4,606,514

[45] Date of Patent: Aug. 19, 1986

[54] METHOD FOR HOMING A PROJECTILE ONTO A TARGET AND FOR DETERMINING THE BALLISTIC TRAJECTORY THEREOF AS WELL AS ARRANGEMENTS FOR IMPLEMENTING THE METHOD

[75] Inventor: Peter Sündermeyer, Lauf/Pegn., Fed. Rep. of Germany

[73] Assignees: Martin-Marietta Corporation, Bethesda, Md.; Diehl GmbH & Co., Nuremberg, Fed. Rep. of Germany

[21] Appl. No.: 639,921

[22] Filed: Aug. 10, 1984

[51] Int. Cl.[4] ..... F41G 7/22

[52] U.S. Cl. ..... 244/3.15

[58] Field of Search ..... 244/3.15, 3.21, 3.16

[56] References Cited

U.S. PATENT DOCUMENTS

| | | | |
|---|---|---|---|
| 3,332,642 | 7/1967 | Halling | 244/3.15 |
| 3,695,555 | 10/1972 | Chadwick | 244/3.16 |
| 4,198,015 | 4/1980 | Yates et al. | 244/3.15 |
| 4,277,038 | 7/1981 | Yates et al. | 244/3.15 |

FOREIGN PATENT DOCUMENTS

| | | | |
|---|---|---|---|
| 2932428 | 2/1981 | Fed. Rep. of Germany . | |
| 3145374 | 6/1983 | Fed. Rep. of Germany | 244/3.15 |
| 2425049 | 1/1980 | France | 244/3.15 |
| 1605007 | 12/1981 | United Kingdom . | |

OTHER PUBLICATIONS

George, Peter J.; Wehrtechnik; 31/79, pp. 19, 22, and 24–27.

*Primary Examiner*—Charles T. Jordan

*Attorney, Agent, or Firm*—Scully, Scott, Murphy & Presser

[57] ABSTRACT

A method for homing a projectile onto a target wherein the projectile is self-steering in an extended trajectory in its flying end phase, in particular an artillery projectile, from which there is effected a search and homing onto a target. Also provided is an arrangement for the change of a projectile which is self-steering and program-controlled during its flight end phase and which is equipped with a target searching device, in particular an artillery projectile, which is equipped with control and steering arrangements and with control rudders for transition from a ballistic firing trajectory into an extended forward trajectory and then for homing into a target approach trajectory. An arrangement is also included for the input of the characteristics of a ballistic launch trajectory into the memory of a navigational computer on board of a projectile which is self-steering along an extended flight end phase.

10 Claims, 4 Drawing Figures

METHOD FOR HOMING A PROJECTILE ONTO A TARGET AND FOR DETERMINING THE BALLISTIC TRAJECTORY THEREOF AS WELL AS ARRANGEMENTS FOR IMPLEMENTING THE METHOD

BACKGROUND OF THE INVENTION

1. Field of the Invention

The present invention relates to a method for homing a projectile onto a target wherein the projectile is self-steering in an extended trajectory in its flying end phase, in particular an artillery projectile, from which there is effected a search and homing onto a target. The invention further relates to an arrangement for the change of a projectile which is self-steering and program-controlled during its flight end phase and which is equipped with a target searching device, in particular an artillery projectile, which is equipped with control and steering arrangements and with control rudders for transition from a ballistic firing trajectory into an extended forward trajectory and then for homing into a target approach trajectory. More particularly, the invention is directed to the provision of an arrangement for the input of the characteristics of a ballistic launch trajectory into the memory of a navigational computer on board of a projectile which is self-steering along an extended flight end phase.

2. Discussion of the Prior Art

Measures of the above-mentioned type and construction for implementing the end-phase steering of artillery projectiles are presently known, referring to the article by Peter J. George in "WEHRTECHNIK" 31/79, pages 19, 22, 24–27) which are fired in a caseless mode and without any self-propulsion devices, such that the projectiles initially traverse a purely ballistic trajectory which is determined by the propellant charge number; in essence, by the firing velocity, and by the elevation of the weapon barrel.

The present invention is thus predicated on the recognition that the conventional end-phase steering and target approach path which is constituted of a linearly controlled trajectory, which in turn follows the ballistic apogee for increasing the range of the projectile, will lead to an impact angle against the target object which is unfavorable with regard to the effect of the war head or combat charge carried by the projectile.

SUMMARY OF THE INVENTION

Accordingly, in recognition of the conditions encountered in the technology, it is a basic object of the present invention to ensure a more favorable angle of impact against a target without, to any material extent, adversely affecting the range of the projectile.

Pursuant to the present invention, there is thus provided a method for the homing of a projectile onto a target, such as an artillery projectile, which is self-steering during its flight end phase along an extended trajectory, from which there is effected a target search and target homing, in that subsequent to detection of the target object which is to be homed on, there is initially maintained the extended or flattened trajectory, prior to the further shortening of the distance with regard to the target object, implementing a pitch-angle control for a transition from the flat flight path or trajectory into a steeper target approach path.

The present invention also provides an arrangement for the steering of a projectile, such as an artillery projectile, which in a program-controlled manner self-steers its flight end phase and which is equipped with a target searching device, with regulating and control mechanisms and with control surfaces for effecting the transition from a ballistic firing trajectory into a flattened range extending trajectory and then for steering into a target approach path. A navigation computer is connected to the output of a memory storing the characteristic data of the ballistic firing trajectory and for the transition therefrom into the extended trajectory, the navigation computer including a trajectory extrapolation computer device to which there is also connected the target searching device, and which determines a pitch-angle change point for a pitch angle change in the steering of the projectile control surfaces so as to provide a steeper target approach path, with the pitch-angle change point being delayed in time in contrast with a target detecting time point, and which is conveyed to a flight-cycle time control circuit such that the extended trajectory is maintained until there is reached the pitch angle change time point.

Thus, not immediately upon the detection of the target object which is to be attacked is the linearly controlled trajectory changed into a target tracking trajectory, but the initiation of the target homing is delayed to maintain the linear trajectory in order then to control over into a trajectory having an increased pitch angle and to thereby attack the target object at a considerably steeper angle, and thereby more effectively.

Since the linear trajectory is ensured through a preprogrammed automatic control on board of the projectile, and the target approach path is ensured through a target searching device on board of the projectile, there must also be determined the time delay interval between the detection of the target object and the change in the pitch angle from the actual flight dynamics of the projectile; in essence, extrapolated with regard to the theoretical end point of the linearly descending trajectory. Consequently, prior to entry into the linearly-controlled trajectory, it is also necessary to take into account the initial firing ballistic trajectory on board the projectile. For this purpose it is known to manually introduce into the projectile which is to be fired (prior to its insertion into the weapon barrel) characteristic values with regard to the barrel elevation and propellant charge number, or also to directly introduce the range which is computable from these parameters and the pregiven linearly-extended trajectory, up the theoretical end point of flight. However, this is complex and, especially under combat conditions, subject to errors.

As a result there is encountered the further problem in connection with, as well as independently of, the angle of attack against the target, of ascertaining on board the projectile, without the requirement for manual data input with regard to the firing conditions, the ballistic or the actual initial trajectory of the fired projectile.

In order to solve this further problem, it is an object of the present invention to provide a method of determining the characteristic data of the ballistic firing trajectory of a projectile, such as an artillery projectile, which provides for self-control of its flight end phase, by measuring on board the projectile, during and subsequent to the firing thereof from a weapon barrel, the muzzle velocity and the time interval between the firing and reaching of the apogee of the projectile, which with reference to pregiven ballistic characteristic values of the projectile, represent a measure of the firing propellant-charge number and the firing elevation angle, and as a result a determination of the ballistic firing trajectory of the projectile.

The invention further provides an arrangement for the input of the characteristic values of a ballistic firing flight into the memory of a navigation computer on board a projectile which his self-steering along an extended or flattened end-phase trajectory, wherein there is provided on board the projectile a time measuring circuit for measuring the time interval (t41 . . . t42) which elapses between the two sensors, positioned offset relative to each other by a certain distance along the axis of the projectile exiting from the muzzle of a firing weapon barrel; and to which circuit there is connected an apogee detector for determining the apogee time interval (t1/t41 . . . t2), whereby any items of information which are dependent upon these time intervals are transmitted to the memory representative of the ballistic firing characteristic values.

This inventive solution to the above-mentioned problem emanates from the recognition that the purely ballistic trajectory or flight path can be determined not only from the firing barrel elevation and propellant-charge number; in effect from data specific to the weapon, but can also be specifically determined from the muzzle velocity and apogee time point; in essence, from actual flight-derived data. These flight-derived data can be ascertained on board the projectile itself, from which data the sought-after trajectory information are rendered available on board the projectile, without having to manually introduce information specific to the weapon.

BRIEF DESCRIPTION OF THE DRAWINGS

Reference may now be had to the following detailed description of a preferred embodiment of the inventive arrangement for homing a projectile onto a target and for determining the ballistic trajectory thereof, taken in conjunction with the accompanying drawings; in which.

DETAILED DESCRIPTION

Figure 1:
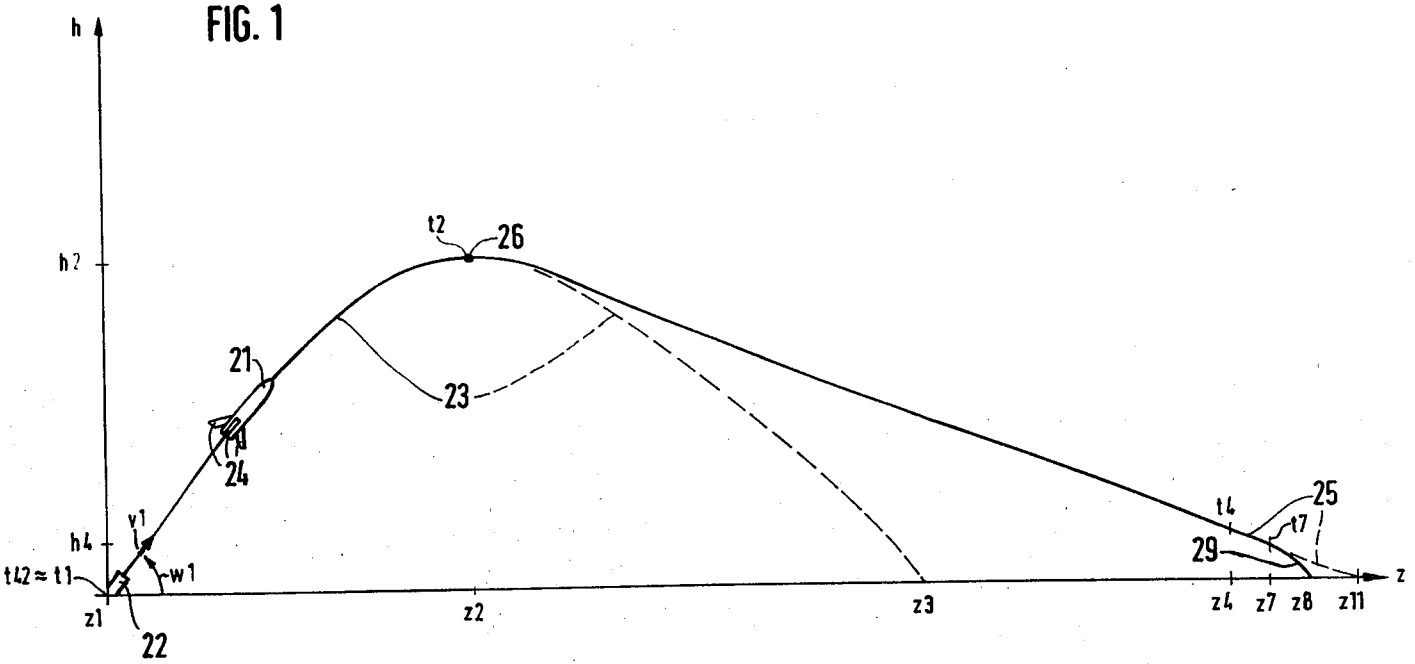
FIG. 1 illustrates the entire trajectory of a projectile along the path traversed above terrain.

The projectile 21 illustrated in FIG. 1 represents a caseless artillery shell which is equipped with control circuits and control components for implementing an end-phase steering and with a built in target searching device for increasing the impact accuracy.

The projectile 21 is fired from a weapon barrel 22. The purely ballistic firing trajectory 23 results from the elevation w1 of the weapon barrel 22 and therewith the orientation of the projectile 21 relative to the horizontal at the firing point z1, considering the flow geometry of the projectile 21, including the conditions of the control fins 24 being extended, as shown, shortly after the firing; and from the firing or muzzle velocity v1 of the projectile 21. The last-mentioned, in turn, is determined by the number (in effect, the quantity) of the firing propellant charges, which are arranged and triggered for the initial acceleration of the projectile 21 rearwardly of the projectile within the weapon barrel 22. For a purely ballistic trajectory 23 there would thus be obtained a ballistic impact point z3.

In order to achieve a greater combat range for the projectile 21, actuation thereof is provided into a non-ballistic, linearly-extended trajectory 25. For this purpose, after flying through the apogee 26 of the height h2 above the location z2, there are initiated program-controlled flight stabilization and control measures through the extension of the control surfaces or fins 24 and lift wings 27 (referring to FIG. 2). From the previously stored reference data for the automatic control along the extended trajectory 25 and the firing-derived ballistic flight data, there was obtained an advanced impact point z11 of the projectile 21 into a correspondingly further distant target zone.

The projectile is controlled out of the ballistic trajectory 23 whereby the resultant-inclination w25 (FIG. 2) of the approximately linear trajectory 25 is typically about 20° relative to the horizontal. Resulting therefrom in the advanced target impact point z11, is an impact path angle w11 in the magnitude of also 20° which, however, represents an unfavorable effective attack angle with regard to the warhead or combat charge in the projectile 21. As a result, there is effected an approach to the target object 28 which is to be attacked at the actual target point z8 at a target approach path 29 which is steeper than the extended trajectory 25, under an actual target path angle w8 which is at least twice as large as the impact path angle w11 in the case of the uninfluenced extended trajectory 25 and, preferably, lies in the magnitude of 45°; so as to thereby ensure a greatly improved degree of effectiveness of the combat charge in the projectile 21 with respect to the target object 28 which is to be attacked.

Figure 2:
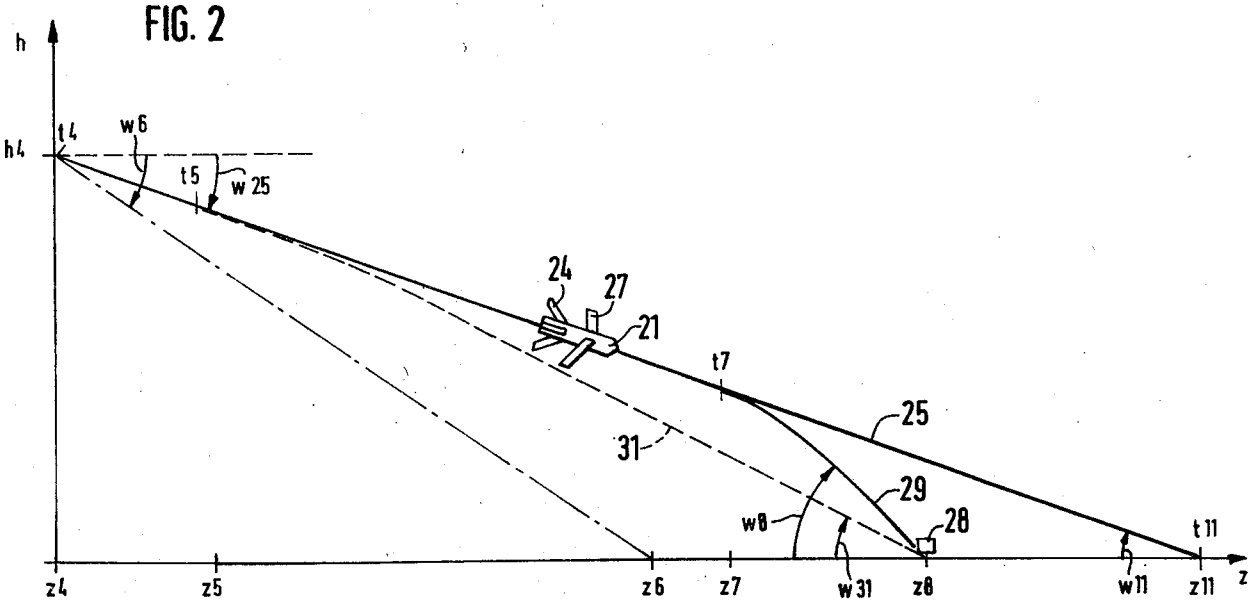
FIG. 2 illustrates in a detail representation, shown on an enlarged scale compared to FIG. 1, the flight end phase with commencement of the target searching phase.
Figure 3:
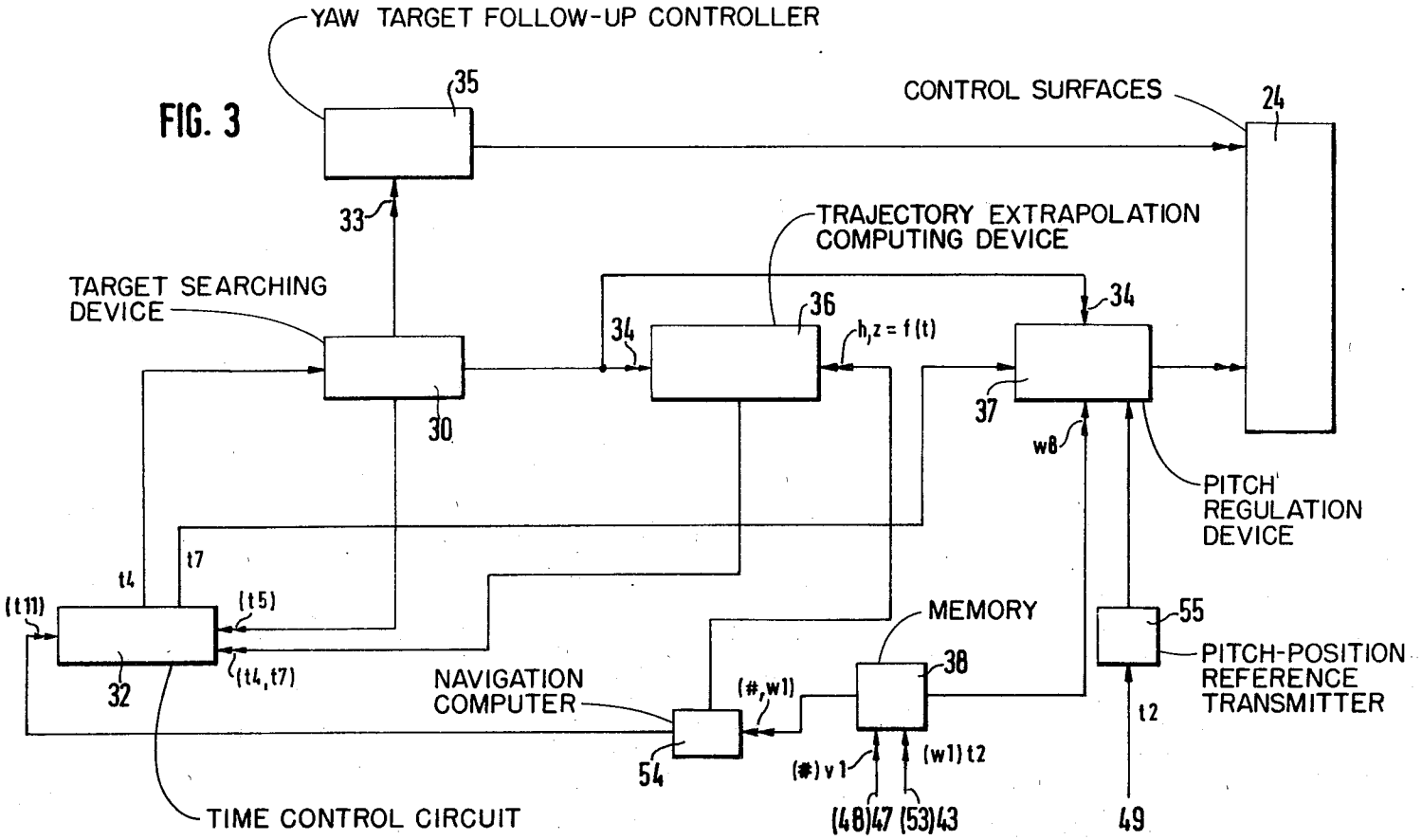
FIG. 3 illustrates a circuit block diagram of the essentially functional influencing elements over the control of the projectile during the flight end phase pursuant to FIG. 2.

The so-called flight end-phase commences with the dropping below of a preprogrammed target searching height h4, which is pregiven in accordance with the target searching and target tracking device 30 which is built into the projectile 21, and in the instance of a millimeter-wave radar target searching device 30, lies in a magnitude, for example of the order of 650 m to 700 m; whereupon there is activated the target searching device 30 (FIG. 3). Inasmuch as constructional limitations restrict the pitch angle with regard to the flight angle of the projectile 21 and because of the somewhat steeper downward inclination of the extended trajectory 25, there is obtained a target-detection limiting angle w6, for example, of 35° (FIG. 2); for reasons of which there can be determined from the position of the search start location z4 only target objects 28 which lie beyond the closest-located detection point z6. Potential target objects beyond the advanced impact point z11 of the flat trajectory 25 cannot, as a rule, be attacked from this trajectory since this would require a reversal in the direction of the trajectory angle w25 which, as a rule, would be impermissible because of high accelerational forces on the projectile which could affect the mechanical stability of the projectile 21 and the devices which are incorporated therein.

When the contemplated target object 28 is to be directly attacked upon being detected by the target searching device 30 through target tracking homing by the projectile, there is set a target tracking path 31 which does deviate downwardly from the extended or flattened trajectory 25, but would still lead to a low and therefore effectively unfavorable impact path angle w31.

Pursuant to the present invention, there is accordingly contemplated that even after detection of the target object 28 which is to be attacked, that it be directly attacked in the target tracking control mode, that its direction of yaw is immediately changed at the target detection point z5 in the direction towards the target object 28, whereas the projectile continues to maintain the actual extended trajectory 25.

The delayed time point t7, for a change in the pitch angle for the deviation from the extended trajectory 25, in accordance with the extent of the approach to the target object 28, with consideration being given to the theoretical end flight period up to the linearly advanced impact point of z11 of the extended trajectory 25 and the intended target approach path 29, is determined on board of the projectile 21 as a delay or remaining flight time period t5–t7. At the time point t7 there are temporarily interrupted the target tracking and the regulation for the previous maintenance of the projectile path inclination w25, and there is assumed a non-controlled change to a steeper pitch angle whereupon the flight attitude regulation is again placed in operation in accordance with this steeper pregiven path impact angle w8, with consideration given to the renewed actuated target tracking, through the target searching device 30.

For these flight phases, represented in FIG. 2 as height-flight path plots, for the attacking of the target object 28 at an optimum target-path impact angle w8, on board of the projectile 21 there is provided a time control circuit 32 (FIG. 3). The circuit 32 determines the function of the time t and thereby, on the basis of the known data of the ballistic and the extended flight paths 23 to 25, the time point such that when falling below the boundary height h4 for the initiation of the target search, the target searching device 30 is set into operation. Upon target detection at the time point t5, the target searching device 30 delivers follow-up control information pertaining to the horizontal target positioning 33 and pertaining to the vertical target positioning 34; always related to the instantaneous spatial orientation of the projectile 21 in its position relative to the extended trajectory 25. The horizontal target position information 33 serves concurrently as the control information for a yaw target follow-up controller 35. In a simple trajectory extrapolation computing device 36, there is determined the time point t7 for the initiation of the pitch maneuver for deviation from the extended trajectory 25, as mentioned, transition into the steeper target approach path 29.

After determination of the time point information t7 and transmission to the time control circuit 32, upon occurrence of the time point t7, a pitch regulation device 37 delivers information on the basis of which the pitch control system is initially interrupted for effecting the change into the steeper target approach path 29; such that after the renewed attaining of a stable flight condition to again set the regulation device 37 into operation, but namely now with the new path-direction reference value w8 and consideration of the follow-up control by the target searching device 30 which is again switched on. Through suitable actuation of the setting elements for the control surfaces or fins 24 from the yaw target follow-up controller 35 and the pitch regulation device 37, there is effected an end-phase steering pursuant to the target approach path 29 up to impact at the target point z8.

For the storing of the characteristic values of the actual data relative to the initial by ballistic trajectory 23 and the subsequent flattened or extended trajectory 25 for the determination of the time point t7 of the pitch angle change, as well as for the determination, derived from the flight path data, of the time point t4 for commencement of the flight end-phase target search, there is provided a memory 38. Introduced into this memory, prior to the firing time point t1 (FIG. 1), or soon thereafter and in any case prior to the transition into the extended trajectory 25 after reaching of the apogee time point t2, are the firing data which determine the ballistic trajectory 23 of the projectile 21, and which correspond to the elevation angle w1 and the muzzle velocity v1 of the projectile 21. Together with the pregiven projectile-type characteristic values in the memory 38, can there be determined through a navigation computer 54 the height-time trajectory plot (as is shown in FIG. 1 and FIG. 2 under consideration of the time coordinates t over the location z), whereupon there can be triggered the described search and control sequences by the time control circuit 32.

The actual elevation velocity data w1, v1, or the distance z1–z11 directly computed therefrom, are usually set through externally accessible setting elements on the projectile 21, which is to be fired, prior to the loading thereof into the weapon barrel 22 in accordance with extent of the inclination w1 of the latter and in accordance with the propellant charges which are to be introduced. However, this manipulation is extremely susceptible to non-reproduceable erroneous procedures, particularly under combat conditions. For this purpose, provision can be made that these input data which are determinative of the trajectories 23–25, and thus for the timewise duration of the control engagements from the time control circuit 32, without the requirement for a manual setting, can immediately after the firing of the projectile 21 be determined on board the projectile 21 itself and introduced into the memory 38.

Two exit sensors 41, 42 which respond to exiting from the muzzle of the weapon barrel 22 are provided so as to determine the muzzle or exit velocity v1, the sensors 41, 42 being mutually offset by a specific distance 39 in the direction of the velocity vector and thereby along the longitudinal direction of the projectile 21. The sensors 41, 42 can be opto-electronic receivers which respond to the jump in the surrounding brightness upon exiting from the weapon barrel 22, or preferably simply coil arrangements which deliver output signals t41, t42 as a result of the field change at the weapon barrel muzzle.

Figure 4:
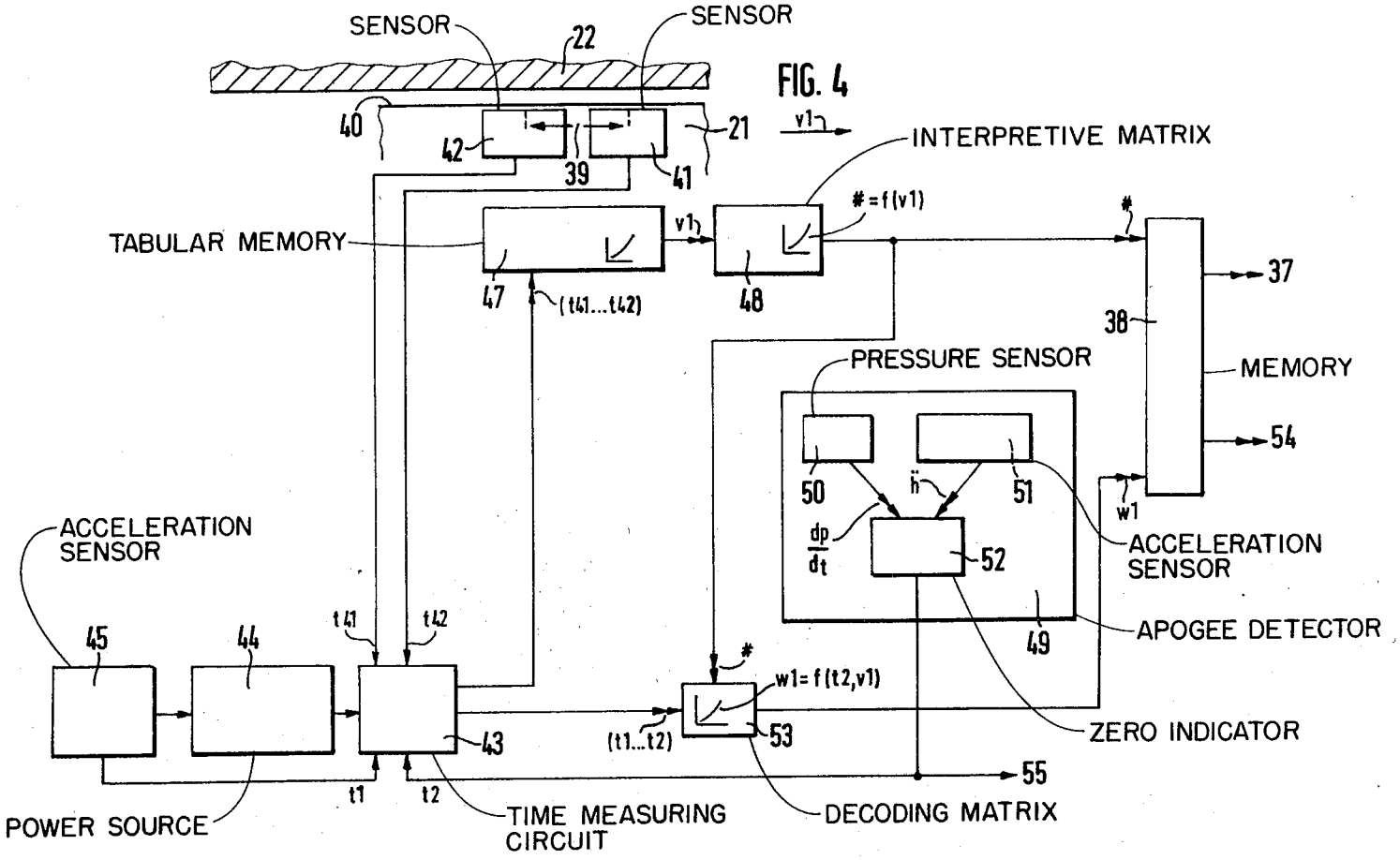
FIG. 4 illustrates a circuit block diagram of an arrangement for an onboard determination of the ballistic firing trajectory of the projectile for the recovery of information for the end-phase control pursuant to FIG. 2.

During, or as a result of the firing of the projectile 21 in the weapon barrel 22, there is activated a power source 44, for example, through actuation from an acceleration sensor 45. The power source 44, for instance, can be an activatable battery, the electrochemical components of which are then brought into operative function with one another, or can be a thermoelectric or piezoelectric generator which, due to the temperature differential behind and ahead of the rearward end of the projectile 21; in effect, on the basis of the initial acceleration thereof, delivers electrical power into the signal processing circuit (pursuant to FIG. 3 and FIG. 4). It is decisive that upon exit from the weapon barrel 22, the electrical power is already always, available, which necessitates a time measuring circuit 43 (for example, a counter circuit for equidistant or regular pulses) in order to determine the time period t41–t42. Since the built-in spacing 39 is constructive pregiven, in essence that it is known; it is adequate for the determination of the firing velocity v1 from each time period t41–t42, to provide in lieu of a computer, a tabular or interpretive memory 47. Connected to the output of the latter can be a corresponding interpretive matrix 48 through which there can be expressed the velocity information as the propellant charge number, as such as is common in the case of artillery; as would the count value pertaining to the firing velocity v1 of the projectile 21.

For a time-dependent or flight path-dependent determination of the ballistic trajectory 23, besides the muzzle velocity v1 knowledge over the firing elevation w1 is necessary; which would be determinable by measuring techniques on the basis of the actual conditions present during the firing of the weapon; however, this information is required on board of the fired projectile 21 so as to, as described in connection with FIG. 3, determine the end point 11 and to derive therefrom the time point for the activation sequences for the delayed and thereby steeper target approach path 29. In recognition of the fact that for a pregiven muzzle velocity v1 of the projectile 21, the time point t2 of its passage through the apogee 26 determines the purely ballistic trajectory, an apogee detector 49 is provided on board of the projectile 21. The apogee detector consists of a pressure sensor 50 which delivers a signal with regard to the timely duration of the first time period of the pressure cycle based on the trajectory height h; or/and consists of an acceleration sensor 51 which directly delivers as an output signal information over the acceleration, or it delivers the second time period of the height course of the ballistic trajectory 23. Connected to the output of the sensors 50 or/and 51 is at least one zero indicator 52 which delivers a signal (t2) to the time measuring circuit 43 when the ballistic trajectory 23 (FIG. 1) traverses in the apogee 26 through its maximum height over the time t or, respectively, over the path z. For the determination of apogee on board of the projectile 21, provision can also be made that the signals delivered from the acceleration sensor 51 which is built into the projectile 21 are evaluated immediately prior to or at the firing of the projectile 21 from the weapon barrel 22.

These signals provide information with regard to the installed orientation of the acceleration sensor which is built into the projectile 21, to thereby provide an indication over the inclination of the projectile in comparison with the vertical, and thereby an indication over the firing elevation w1 with regard to the horizontal. The apogee time point t2 can be evaluated through the measurement results of the fixing velocity v1 through currently known, constructively-determined aerodynamic properties of the projectile 21. This information over the firing elevation w1 can also be employed to preset a gyro system which is activated immediately after firing, using this fixing elevation as a reference. The data delivered by the gyro system can be employed to derive the horizontal orientation of projectile 21 at passage through the point of apogee t2.

The time period t1 (in essence with sufficient accuracy t41 or t42)-t2, thus represents the second necessary characteristic value for determining the theoretical course of the purely ballistic trajectory 23. Together with the already determined information corresponding to the actual propellant charge number, through the use of a further tabular or decoding matrix 53 on board of the projectile 21 there can be determined the associated value of the firing elevation w1, in effect, the matrix input information can be directly evaluated for flight path determination.

These items of information (v1, t2), which correspond to the decisive characteristic data (w1, propellant charge number) for the description of the ballistic trajectory 23, as elucidated in connection with FIG. 3, are stored for the interim in the memory 38 in order to determine therefrom through navigation computer 54, the theoretical impact time point t11 of the projectile 21 at the advanced flight path end point z11. From this impact time point t11, which occurs only in the absence of a target detection, then through the computer device 36 on board the projectile 21, as elucidated in connection with FIG. 2 and FIG. 3, there is extrapolated which delayed time period t5–t7 after target detection (t5 through z5) is to be pregiven up to the delayed pitch angle change, in order to then initiate the target approach path 29, which provides the extensively improved steeper impact path angle w8 by the timing control circuit 32.

These time point determinations and trajectory transitions can be ensured, at comparatively low demands, in an exceedingly precise and reproducible manner on board of the projectile 21, since in any event as described previously an apogee detector 49 (FIG. 4) is present on board the projectile 21 for the combination of the trajectories 23 to 25. The foregoing is encountered since the apogee 26 of the ballistic firing trajectory (which the projectile leaves only after passing the apogee) extends transiently horizontally; and because the flight attitude of the projectile 21 upon passage through the apogee 26 is practically horizontal, or in any event deviates only to a slight (and in this respect pregiven, or known) incident flight angle relative to the horizontal. Therefore, at the apogee time point t2, the momentary orientation of the projectile 21 in space can be assumed as a horizontal reference position for the function of the pitch regulation device 37 (for control of the projectile along the trajectories 25 and 29), for example, by resetting or zeroing a gyro-stabilized positional reference system and of a pitch speed integrator, such as is symbolically considered in FIG. 3 by a pitch-position reference transmitter 55. The end-phase steering control, which is significant for the accuracy of fire, along the extended trajectory 25 is thus implemented in an overall precise manner, since prior thereto, namely directly before leaving the ballistic trajectory 23, which pitch reference value, significant for the flight path angle w25/11, has been recovered from the actual flight conditions of the projectile 21 itself.

What is claimed is:

1. In a method for homing a projectile onto a target wherein said projectile is self-steering in its end flying phase along an extended trajectory, such as an artillery projectile, from which there is effected a target searching and target homing sequence; the improvement comprising: initially maintaining the extended trajectory subsequent to detecting the target object which is to be homed on; thereafter effecting a pitch angle control for transition from the extended trajectory into a steeper target approach trajectory at a further shortening of the distance towards the target object; determining the theroretical impact point on board the projectile from given firing data and from pregiven conditions during transition from an initial ballistic trajectory into said extended trajectory; and calculating on board said projectile, for said steeper target approach path towards the target object, the delay time period for transiently maintaining the extended trajectory up to the time point of leaving said extended trajectory into the target approach path at a steeper pitch angle.

2. Method as claimed in claim 1, through evaluating of the characteristic data of a ballistic firing trajectory of the projectile, comprising obtaining reference information for the recovery of a ballistic flight path for a time-dependent target approach control after detection of a target object on baord the projectile at approximately the point in time of firing of the projectile, with regard to characteristic reference values of the uninfluenced ballistic trajectory of the projectile from a predetermined firing velocity and firing elevation of said projectile.

3. Method as claimed in claim 2, comprising measuring the time point of apogee passage of the projectile on board the projectile.

4. Method as claimed in claim 2, comprising evaluating on board the projectile, at approximately the point in time of the firing of the projectile, acceleration measurement signals for recovery of information over the uninfluenced ballistic trajectory, such as the apogee time point from the firing time point.

5. Method as claimed in claim 2, comprising measuring for determination for the firing velocity a time period which lies between two points along the projectile at a defined spacing relative to each other given between the exit times thereof when the fired projectile exits a weapon barrel.

6. Method as claimed in claim 2, wherein a time period is measured for determining the firing elevation of the projectile, which extends between one time point in the forward movement of the projectile within the weapon barrel and the time point at which the uninfluenced ballistic firing trajectory of the projectile passes its maximum height.

7. In an arrangement for the control of a projectile which is self-steering and program-controlled during its end flying phase and which is equipped with a target searching means, in particular an artillery projectile, including regulating and control means, and control fins for transition from a ballistic firing trajectory into an extended forward advancing trajectory, and then for actuation into a target approach path; the improvement comprising: a memory for storing reference data over the ballistic firing trajectory and for the transition effected into the extended trajectory, said memory being connected with the output of a navigational computer including trajectory extrapolation computer means, said target searching means being connected therewith and determining the delay time period up to the reaching of a pitch angle control time point which is delayed relative to the target detecting time point while maintaining the extended trajectory, so as to actuate the projectile control fins to effect a steeper target approach path and to transmit the information into a flight duration-time control circuit.

8. An arrangement for the introduction of reference data over a ballistic firing trajectory to a memory of a navigational computer on board a projectile which is self-steering along an extended end phase trajectory; including a time measuring circuit on board the projectile for the measurement of the time period which passes between the exit of two sensors which are offset relative to each other along the axis of the projectile by a definite distance from the muzzle of a weapon barrel from which the projectile is fired; a measurement circuit being connected to the time measuring circuit for determining the apogee time period, the information dependent upon said time periods being transmitted to the memory as the ballistic firing trajectory reference data.

9. Arrangement as claimed in claim 8, wherein the projectile includes an acceleration sensor for determining the apogee time period.

10. Arrangement as claimed in claim 8, including a pitch position reference transmitter which, upon passage through the apogee, transmits horizontal reference information into pitch controlling means.

* * * * *